US008001646B2

(12) United States Patent
Blom

(10) Patent No.: US 8,001,646 B2
(45) Date of Patent: Aug. 23, 2011

(54) CLEANING MOP HAXAN TOOL

(75) Inventor: Dan Blom, Paramount, CA (US)

(73) Assignee: Aquastar, Inc., Paramount, CA (US)

( * ) Notice: Subject to any disclaimer, the term of this patent is extended or adjusted under 35 U.S.C. 154(b) by 735 days.

(21) Appl. No.: 12/113,792

(22) Filed: May 1, 2008

(65) Prior Publication Data

US 2009/0271937 A1 Nov. 5, 2009

(51) Int. Cl.
*A47L 13/20* (2006.01)

(52) U.S. Cl. ..... 15/228; 15/231; 15/114

(58) Field of Classification Search ..... 15/114, 15/115, 117, 228, 231, 229.6, 116, 116.2, 15/119.2, 120.2, 118, 172
See application file for complete search history.

(56) References Cited

U.S. PATENT DOCUMENTS

| | | | | |
|---|---|---|---|---|
| D165,753 | S * | 1/1952 | Herron | D4/119 |
| 5,966,771 | A * | 10/1999 | Stroud | 15/117 |
| 6,625,837 | B2 * | 9/2003 | Jiang | 15/105 |
| 6,804,853 | B2 * | 10/2004 | Wang | 15/172 |
| 2006/0282967 | A1 * | 12/2006 | Williams et al. | 15/111 |

* cited by examiner

*Primary Examiner* — Dung Van Nguyen
(74) *Attorney, Agent, or Firm* — Marc E. Hankin; Kevin Schraven; Hankin Patent Law, A.P.C.

(57) ABSTRACT

The invention relates to a cleaning mop, including a handle fixed onto a cylindrical coupler having rotational capability; a joint fixed to the cylindrical coupler; a retainer for retaining a cleaning element; and a scrubber formed with projections on one part and fins on the other part, the fins extending side to side along the scrubber. The scrubber can be formed to have a circular cross-section. It also can be formed to have a polygonal cross-section. Each surface of the polygon is formed alternatively with either irregularly spaced projections or regularly spaced fins, such that the projections and fins alternate on every other face of the polygon.

8 Claims, 6 Drawing Sheets

(Prior Art)

CLEANING MOP HAXAN TOOL

FIELD OF INVENTION

This invention relates, generally, to cleaning mops. More particularly, this invention relates to cleaning mops structured to meet specific requirements and challenges related to cleaning a variety of surfaces.

This application claims priority to the U.S. patent application Ser. No. 11/766,789 filed on Jun. 21, 2007, for "Detachable Extension Handle," the contents of which are incorporated herein by reference in their entirety. Furthermore, this application claims priority to the U.S. patent application Ser. No. 11/871,531 filed on Oct. 12, 2007, for "System for Detachably Connecting Mop Heads, Mop Pads, and the Like," the contents of which are incorporated herein by reference in their entirety.

BACKGROUND

FIG. 1 illustrates a traditional mop 10 that is constructed as follows: An adhesive pad 11 is attached to a board panel 12; the board panel 12 is fixed by a bolt 13; the board panel top 15 is connected to cylindrical coupler 16 by rotating connecting part (coupling) 14; the handle 17 is extends from cylindrical coupler 16.

From the user's perspective, traditional mop 10 has difficulty cleaning uneven surfaces such as carpet. This is due, in part, to the shape and size of cleaning pad, which is too straight and too big, therefore unsuitable for cleaning uneven surfaces.

SUMMARY OF THE INVENTION

Embodiments of this invention are directed towards overcoming the above shortcomings by providing multi-purpose cleaning abilities, applicable to many different surfaces, including uneven surfaces such as carpet.

In one embodiment, a cleaning mop is constructed as follows: a handle is fixed onto a cylindrical coupler having rotational capability; a joint is fixed to the cylindrical coupler; a retainer for retaining a cleaning element is included; and a scrubber is formed with projections on one part and fins on the other part, extending side to side along the scrubber. The scrubber can be formed to have a circular cross-section. It also can be formed to have a polygonal cross-section. Each surface of the polygon is formed alternatively with either irregularly spaced projections or regularly spaced fins, such that the projections and fins alternate on every other face of the polygon.

Other features and advantages of this invention will become apparent from the following description of several embodiments of the invention, taken in conjunction with the accompanying drawings, which illustrate, by way of example, the principles of the invention.

DRAWINGS—REFERENCE NUMERALS

Figure 1:
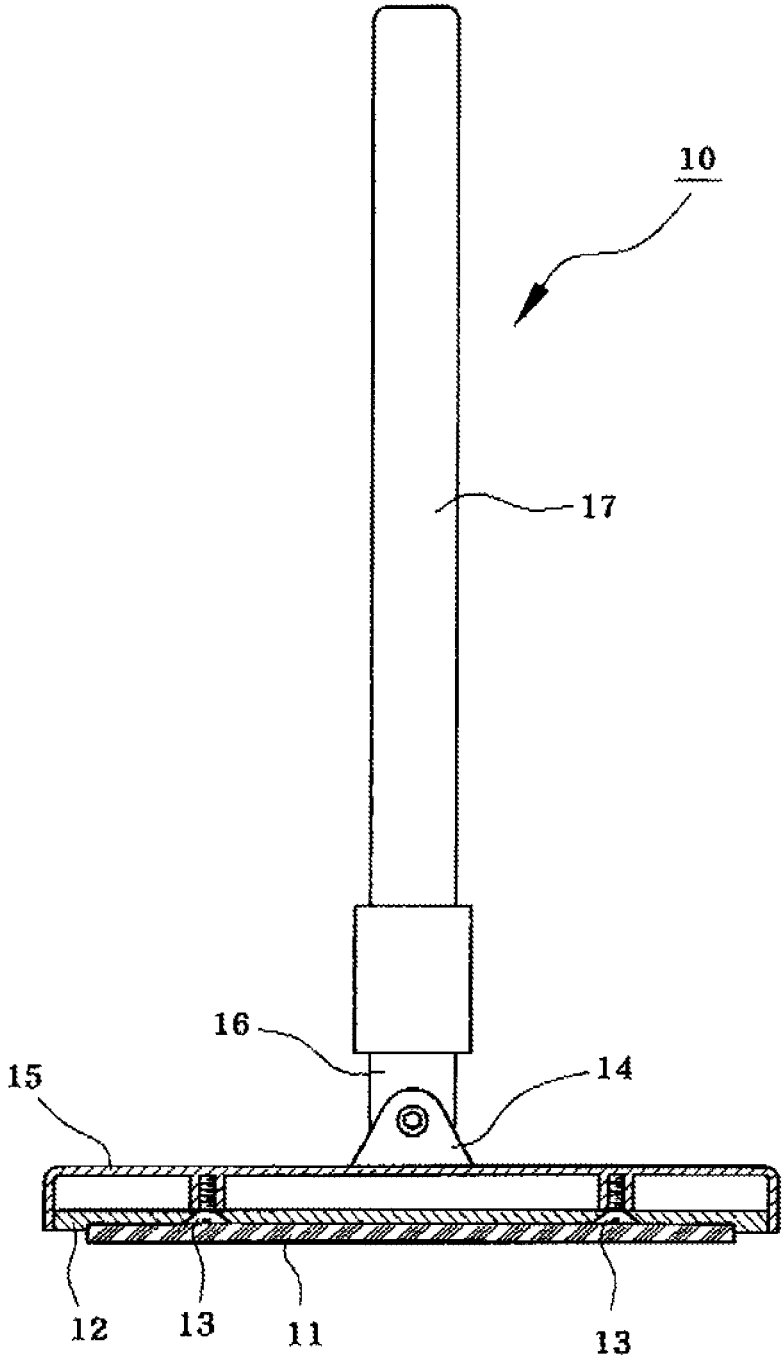
FIG. 1 is a front view of a traditional mop according to the prior art.

10: traditional mop
11: adhesive pad
12: board panel
13: bolt
14: coupling
15: board panel top
16: cylindrical coupler
17: handle
20: cleaning mop
22: handle
30: scrubber
32: fins
34: projections
36: joint
38: retainer
40: cylindrical coupler
50: cleaning mop
52: handle
60: polygonal scrubber
62: fins
64: projections
66: joint
68: retainer
70: cylindrical coupler
100: cleaning element

DETAILED DESCRIPTION OF THE DRAWINGS

In the following detailed description of various embodiments of the invention, numerous specific details are set forth in order to provide a thorough understanding of various aspects of one or more embodiments of the invention, however, one or more embodiments of the invention may be practiced without these specific details. In other instances, well-known methods, procedures, and/or components have not been described in detail so as not to unnecessarily obscure aspects of embodiments of the invention.

In the following description, certain terminology is used to describe certain features of one or more embodiments of the invention. For instance, "cleaning mop" or "mop" refers to any type of "cleaning device," and "fins" refers to any panel or projection that is used to conform to contours and/or surface variations.

Figure 2:
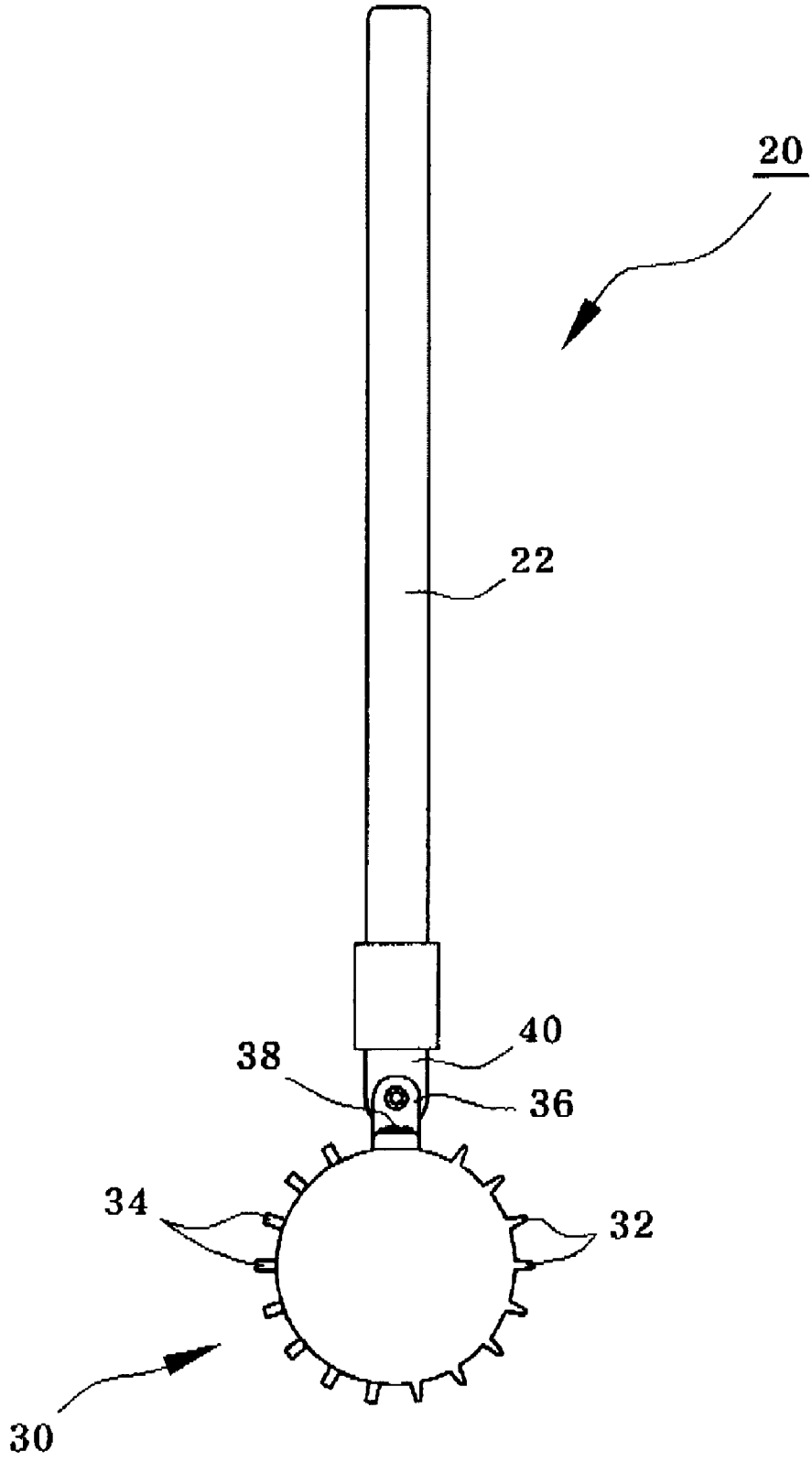
FIG. 2 is a side view of an embodiment of a cleaning mop according to the present invention.

FIG. 2 illustrates a side view of an embodiment of a cleaning mop according to the present invention. Cleaning mop 20 includes a handle 22 and a scrubber 30. Handle 22 is connected to the scrubber 30 via a cylindrical coupler 40 and a joint 36. The cylindrical coupler 40 provides a rotating ability, such that the joint 36 and scrubber 30 can rotate with respect to the handle 22. Joint 36 provides a pivoting ability, such that the scrubber 30 can pivot with respect to the cylindrical coupler 40 and handle 22. The cylindrical coupler 40 and/or the joint 36 can include a spring-loaded capability, to encourage positive contact between the scrubber 30 and the surface to be cleaned during use, while the scrubber 30 follows along the surface as the cylindrical coupler 40 rotates and the joint 36 pivots.

Figure 4A:
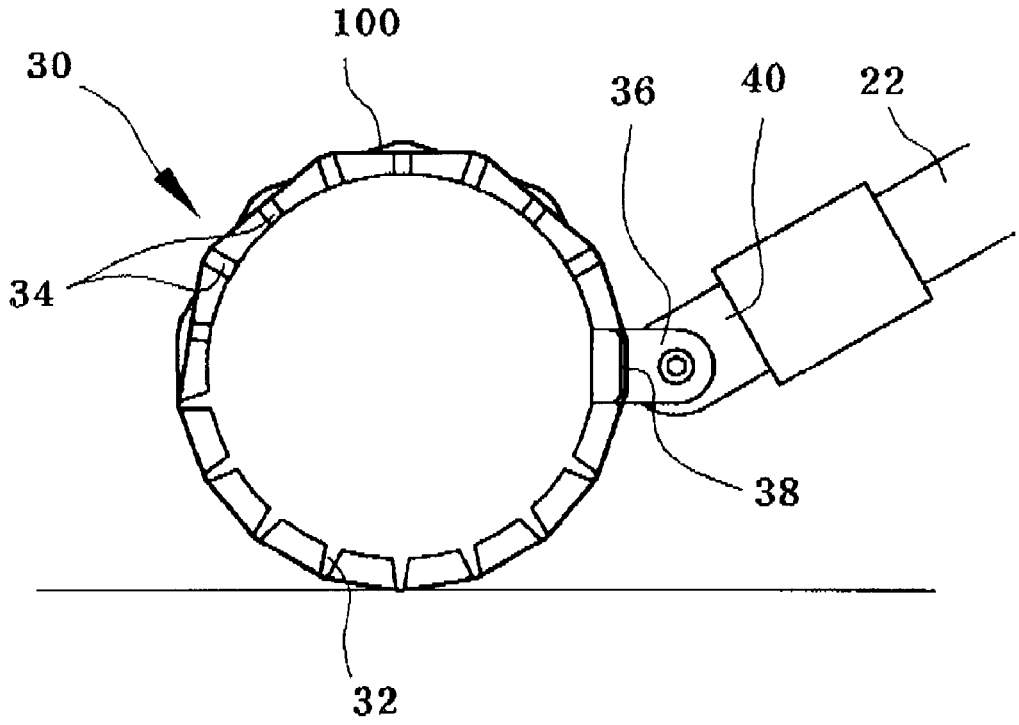
FIG. 4*a* is a side detail view of an embodiment of a cleaning mop according to the present invention used on an even surface.
Figure 4B:
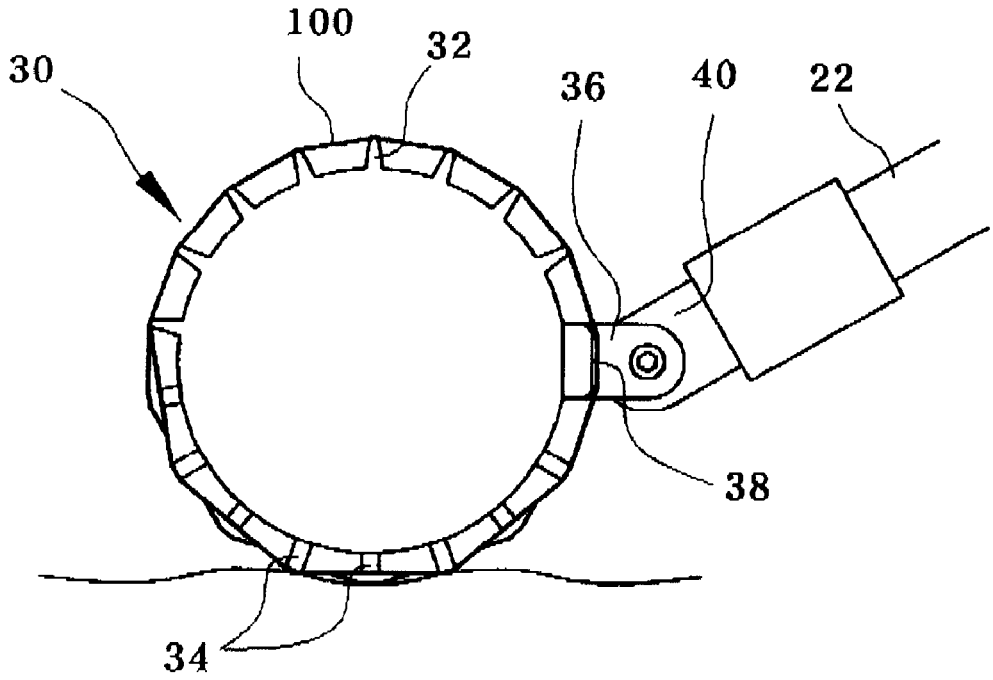
FIG. 4*b* is a side detail view of an embodiment of a cleaning mop according to the present invention used on an irregular surface.

Scrubber 30 includes a retainer 38 configured to attach a replaceable cleaning element 100 (see FIGS. 4*a* and 4*b*). Retainer 38 can be attachable and detachable from the scrubber 30, and retainer 38 can include adhesives for attaching the cleaning element 100. Retainer 38 can incorporate alternative retention capabilities, including hook-and-loop, frictional tabs, and the like, in addition to adhesives. Retainer 38 can be removed and replaced, especially in situations where the adhesives (or other capabilities) become contaminated or otherwise weakened over time and/or use.

As illustrated, scrubber 30 includes fins 32 along one side and projections 34 along the other, although any combinations and/or patterns of fins 32 and projections 34 are contemplated. For example, the fins 32 extend laterally along the entire width of the scrubber 30 (see also FIG. 3), and the projections 34 are positioned irregularly along the scrubber 30. Alternatively, projections 34 can be positioned in regular rows, with each projection alternating with the spaces positioned between adjacent projections forming each of the adjacent rows (see also FIG. 3). The cleaning element 100 (see FIGS. 4*a* and 4*b*) can be wrapped around the scrubber 30 and secured in place by retainer 38.

Figure 3:
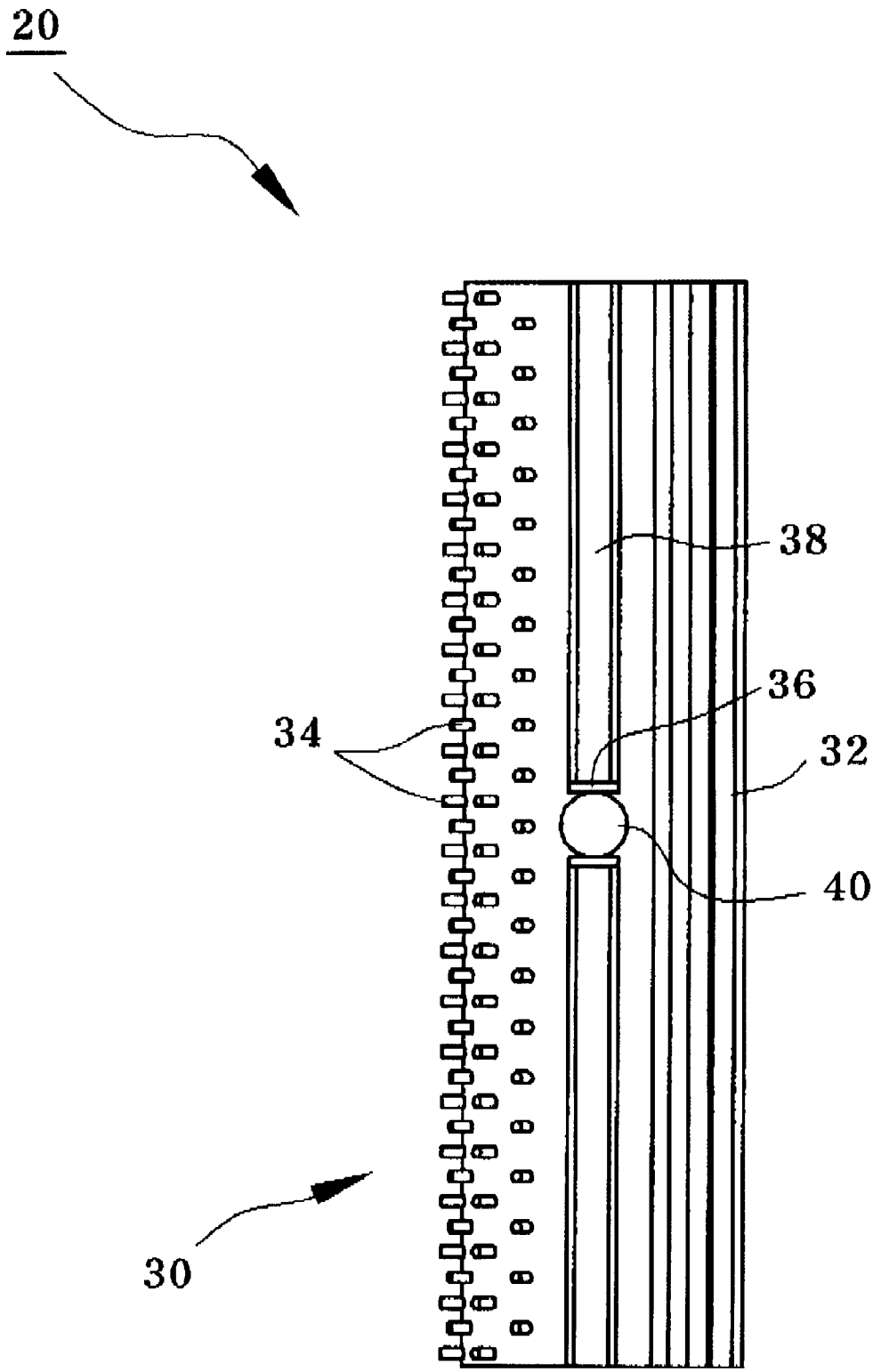
FIG. 3 is a top detail view of a portion of the embodiment illustrated in FIG. 2.

FIG. 3 illustrates a top detail view of a portion of the embodiment illustrated in FIG. 2. The retainer 38 is visible, extending laterally from the cylindrical coupler 40 along the top of the scrubber 30. Fins 32 extend fully across one side of scrubber 30, and an irregular pattern of projections 34 extend from the other side of scrubber 30.

FIG. 4*a* illustrates a side detail view of an embodiment of a cleaning mop according to the present invention, used on an even surface. Cleaning element 100 is secured by retainer 38, wrapped around scrubber 30 including its fins 32 and projections 34. The cleaning element 100 can include a texture that interacts with the projections 34, and that can alter the surface contour of the cleaning element 100. For example, as illustrated in FIGS. 4*a* and 4*b*, the cleaning element 100 protrudes from the scrubber 30 to provide enhanced cleaning capabilities. Cleaning element 100 can be a pad, fabric, rag, cloth, textile, paper, or other device suitable for cleaning surfaces. The fins 32 and projections 34 push the cleaning element 100 into the surface to be cleaned.

As illustrated, the scrubber 30 is positioned with fins 32 downward, held flush against the even surface. Projections 34 face upwards. Contact between the scrubber 30 and the surface (via cleaning element 100) is enhanced via joint 36 and cylindrical coupler 40. As illustrated, joint 36 is flexed to allow the scrubber 30 to maintain positive contact with the surface. Joint 36 can include a spring effect to provide positive force against the surface. Additionally, scrubber 30 can fall into alignment laterally with the surface, due in part to the action of cylindrical coupler 40 that allows the scrubber 30 and joint 36 to rotate about the axis of the handle 22. Cylindrical coupler 40 can also include a spring effect to provide positive feedback to the user via the handle 22, and to ensure contact with the surface. Accordingly, cleaning element 100 is pressed consistently against the even surface, to ensure optimal cleaning.

FIG. 4*b* illustrates a side detail view of an embodiment of a cleaning mop according to the present invention used on an irregular surface. The irregular surface can include various surfaces such as carpet, tiles, or the like. Scrubber 30 is positioned with the projections 34 facing downward toward the uneven surface. The joint 36 is flexed to ensure that the cleaning element 100 is pressed against the uneven surface, to ensure optimal cleaning. As illustrated, the textured portion of the cleaning element 100 is in direct contact with the uneven surface. Projections 34 enhance the contact between the cleaning element 100 and the uneven surface. Any lateral variations in the uneven surface can be accommodated by the scrubber 30 as it rotates about the cylindrical coupler 40 thus ensuring proper contact.

Figure 5:
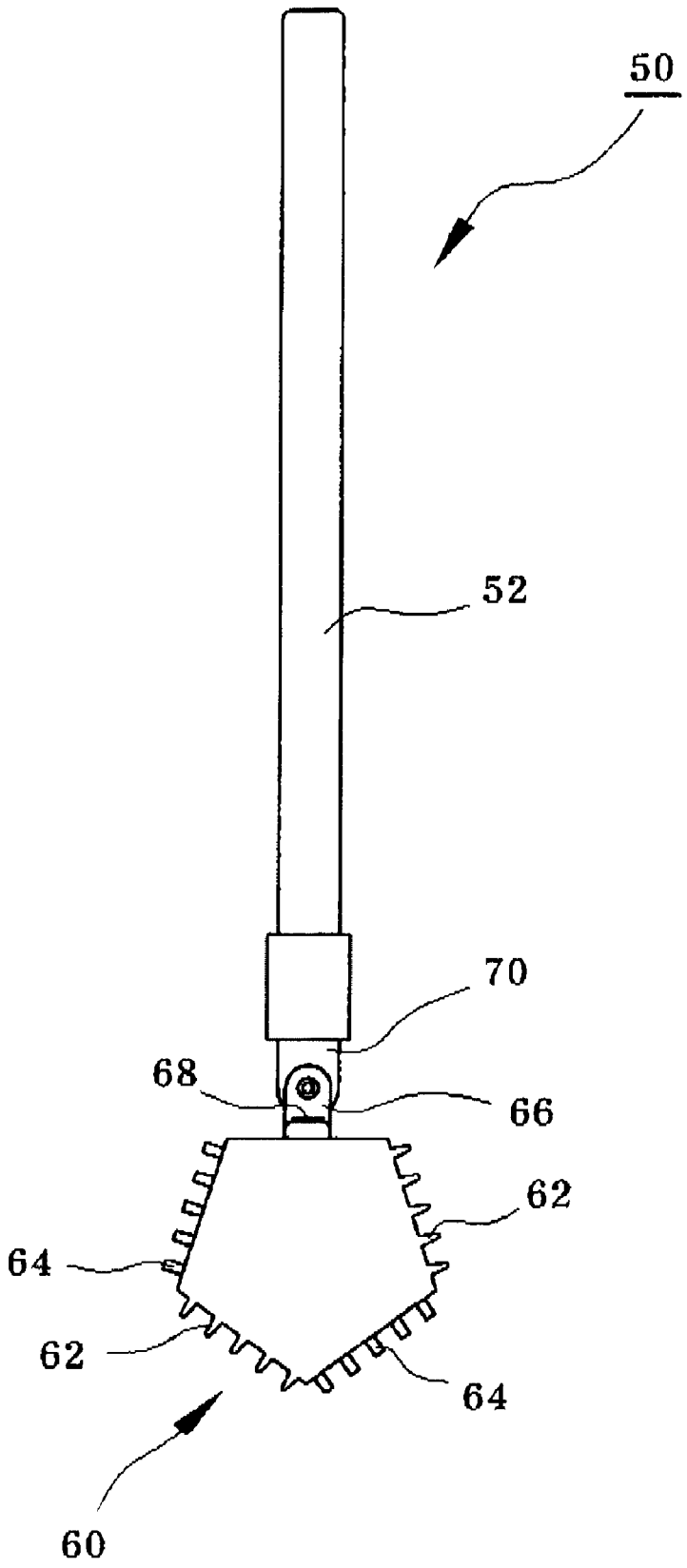
FIG. 5 is a side view of an embodiment of a cleaning mop according to the present invention.

FIG. 5 illustrates a side view of an embodiment of a cleaning mop according to the present invention. Cleaning mop 50 includes a handle 52 and a polygonal scrubber 60. Handle 52 is connected to the polygonal scrubber 60 via a cylindrical coupler 70 and a joint 66. The cylindrical coupler 70 provides a rotating ability, such that the handle 52 can be rotated with respect to the joint 66 and polygonal scrubber 60. Joint 66 provides a pivoting ability, such that the polygonal scrubber 60 can pivot with respect to the cylindrical coupler 70 and handle 52. The cylindrical coupler 70 and/or the joint 66 can include a spring-loaded capability, to encourage positive contact between the polygonal scrubber 60 and the surface to be cleaned during use, while the polygonal scrubber 60 follows the surface as the cylindrical coupler 70 rotates and the joint 66 pivots.

Polygonal scrubber 60 includes a retainer 68 configured to attach a cleaning element 100 (see FIGS. 4*a* and 4*b*). Retainer 68 can be attachable and detachable from the polygonal scrubber 60, and retainer 68 can include adhesives for attaching the cleaning element 100. Retainer 68 can incorporate alternative retention capabilities, including hook-and-loop, frictional tabs, and the like, in addition to adhesives. Retainer 68 can be removed and replaced, especially in situations where the adhesives (or other capabilities) become contaminated or otherwise weakened over time and/or use.

As illustrated, polygonal scrubber 60 includes fins 62 along two alternate faces and projections 64 along the other alternate faces, although any combinations and/or patterns of fins 62 and projections 64 are contemplated. For example, the fins 62 can extend laterally along the entire width of two faces of the polygonal scrubber 60, and the projections 64 can be positioned irregularly along two faces of the polygonal scrubber 60. Alternatively, projections 64 can be positioned in regular rows, with each projection alternating with the spaces positioned between adjacent projections forming each of the adjacent rows. The cleaning element 100 (see FIGS. 4*a* and 4*b*) can be wrapped around the polygonal scrubber 60 and secured in place by retainer 68.

Figure 6:
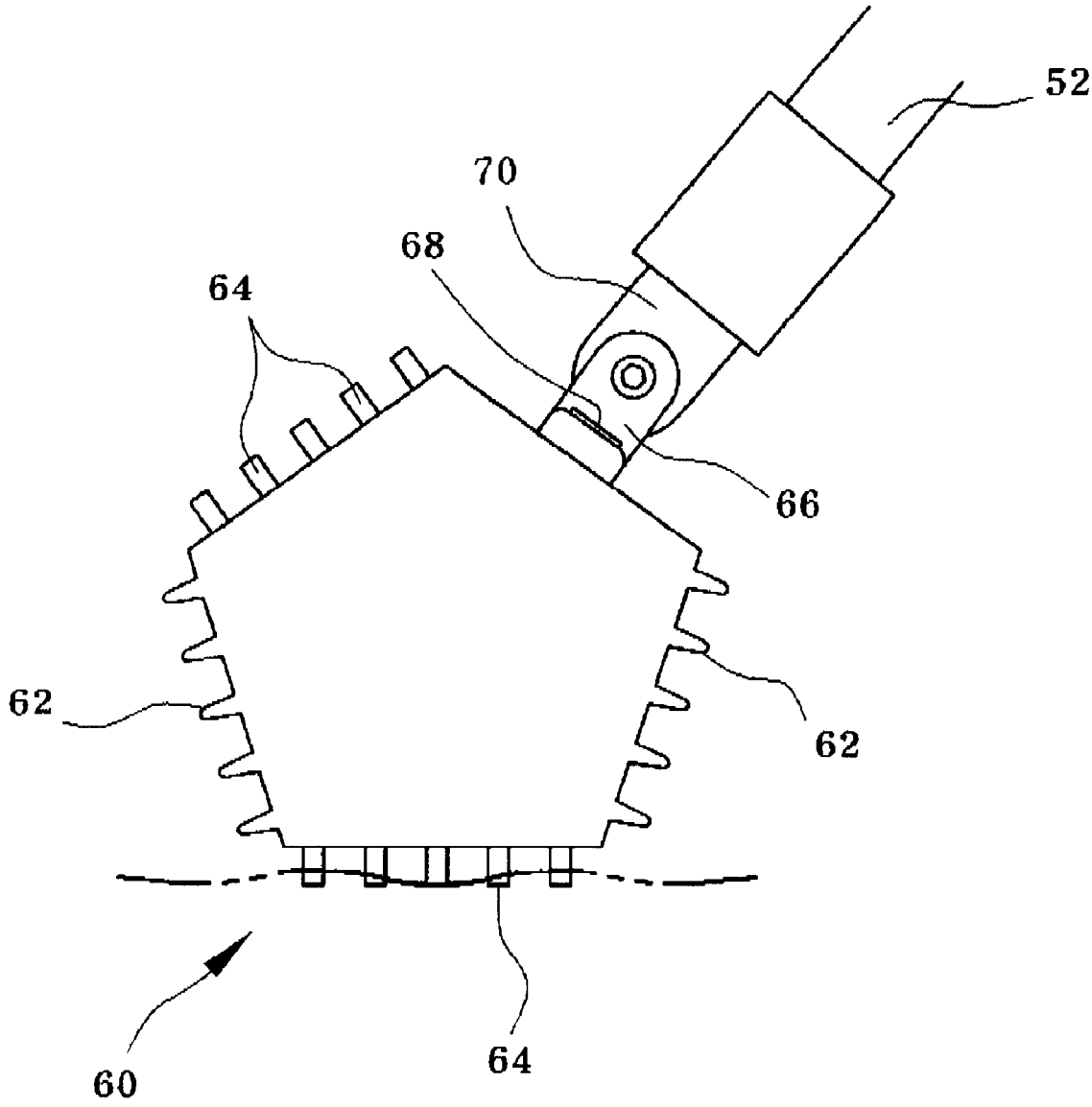
FIG. 6 is a side detail view of the embodiment illustrated in FIG. 5 in use on an irregular surface.

FIG. 6 illustrates a side detail view of the embodiment illustrated in FIG. 5 used on an irregular surface. As illustrated, the cleaning mop is used without a cleaning element 100 in place, such that the projections 64 come in direct contact with the uneven surface. Furthermore, the polygonal cross-section of the polygonal scrubber 60 allows a face of the polygonal scrubber 60 to be generally parallel to the uneven surface, with minimal flexing of joint 66 even while the handle 52 is held at an angle during use. Various polygonal shapes can be used, in addition to the pentagonal shape illustrated in FIGS. 5 and 6.

Thus, the various embodiments of the fins, projections, and cross-sectional shape (polygon, circle, etc.) of the cleaning mop can be used on many different types of surfaces and floors as needed, while the joint and cylindrical coupler accommodate any variations during use.

While multiple embodiments are disclosed, still other embodiments of the present invention will become apparent to those skilled in the art from the foregoing detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive. Also, the reference or non-reference to a particular embodiment of the invention shall not be interpreted to limit the scope of the invention. Various embodiments of the invention remain useable in tandem or combination of one another.

What is claimed is:

1. A cleaning mop, comprising:

a handle;

a cylindrical coupler rotatably attached to the handle;

a joint attached to the cylindrical coupler; a scrubber attached to the joint;

a retainer attached to the scrubber;

wherein the scrubber includes projections covering a portion of the scrubber, and fins covering a portion of the scrubber and extending lengthwise along a full width of the scrubber; and a cleaning element wrapped around the scrubber and held in place by the retainer, such that the projections and the fins are covered by the cleaning element.

2. The cleaning mop of claim 1, wherein: the scrubber has a circular cross-section.

3. The cleaning mop of claim 1, wherein: the scrubber has a polygonal cross-section.

4. The cleaning mop of claim 3, wherein: faces of the polygon alternate between a face covered with projections and a face covered with fins.

5. The cleaning mop of claim 3 wherein: the polygonal cross-section is pentagonal.

6. The cleaning mop of claim 1, wherein: the cleaning element includes a texture to enhance cleaning.

7. The cleaning mop of claim 1, wherein: the joint is spring-loaded to ensure positive contact between the scrubber and a surface when the cleaning mop is in use.

8. The cleaning mop of claim 1, wherein: the cylindrical coupler is spring-loaded to ensure positive contact between the scrubber and a surface when the cleaning mop is in use.

* * * * *